US011000745B1

(12) United States Patent
Hanes

(10) Patent No.: US 11,000,745 B1
(45) Date of Patent: May 11, 2021

(54) SPORTS PROJECTILE TRAINING DEVICE

(71) Applicant: Brad Hanes, Waterloo, IA (US)

(72) Inventor: Brad Hanes, Waterloo, IA (US)

( * ) Notice: Subject to any disclaimer, the term of this patent is extended or adjusted under 35 U.S.C. 154(b) by 0 days.

(21) Appl. No.: 16/728,347

(22) Filed: Dec. 27, 2019

(51) Int. Cl.

| | |
|---|---|
| ***A63B 63/00*** | (2006.01) |
| ***A63B 69/40*** | (2006.01) |
| ***A63B 71/02*** | (2006.01) |
| *A63B 69/00* | (2006.01) |
| *A63B 102/18* | (2015.01) |
| *A63B 102/14* | (2015.01) |
| *A63B 69/38* | (2006.01) |

(52) U.S. Cl.
CPC ..... *A63B 63/004* (2013.01); *A63B 71/023* (2013.01); *A63B 69/002* (2013.01); *A63B 69/0002* (2013.01); *A63B 69/0024* (2013.01); *A63B 69/0026* (2013.01); *A63B 69/38* (2013.01); *A63B 2069/0006* (2013.01); *A63B 2102/14* (2015.10); *A63B 2102/182* (2015.10); *A63B 2209/00* (2013.01); *A63B 2210/50* (2013.01); *A63B 2225/09* (2013.01); *A63B 2243/007* (2013.01)

(58) Field of Classification Search
CPC . A64B 63/004; A64B 71/023; A64B 69/0002; A64B 69/002; A64B 69/0024; A64B 69/0026; A64B 69/38; A63B 2069/0006
USPC ..... 473/446, 197, 422, 476–478
See application file for complete search history.

(56) References Cited

U.S. PATENT DOCUMENTS

| | | | | | |
|---|---|---|---|---|---|
| 920,907 | A * | 5/1909 | Bolton | A63B 71/022 | 473/197 |
| 1,923,152 | A * | 8/1933 | Kohn | A63B 63/00 | 473/190 |
| 3,227,449 | A * | 1/1966 | Schwab | A63B 63/00 | 473/439 |
| 3,349,620 | A * | 10/1967 | Speiser | A63B 24/0021 | 473/192 |
| 3,986,719 | A * | 10/1976 | Lee | A63B 63/00 | 473/197 |
| 5,193,802 | A * | 3/1993 | Saltus | A63B 63/00 | 473/197 |
| 5,421,586 | A * | 6/1995 | Amram | A63B 63/004 | 273/127 B |
| 5,725,444 | A * | 3/1998 | Heden | A63B 63/00 | 473/446 |

(Continued)

*Primary Examiner* — Mitra Aryanpour
(74) *Attorney, Agent, or Firm* — PatentFile, LLC; Bradley C. Fach; Steven R. Kick

(57) ABSTRACT

A sports projectile training device may include a frame having a frame aperture. A base sheet may be coupled to the frame and may extend across portions of the frame aperture. The base sheet may include a plurality of base apertures which may be sized and shaped so that the sports projectile may pass through the base apertures. A cover sheet having an exterior surface may be positioned over the base sheet so that the exterior surface and base sheet are positioned on opposing sides of the cover sheet. A sports projectile may be motivated towards the device so that the sports projectile impacts the exterior surface. This impact may cause the sports projectile to press a portion of the cover sheet into a base aperture to arrest the sports projectile within the base aperture so that the sports projectile is cradled in the base aperture by the exterior surface.

20 Claims, 9 Drawing Sheets

(56) References Cited

U.S. PATENT DOCUMENTS

| | | | | | |
|---|---|---|---|---|---|
| 5,863,266 | A * | 1/1999 | Starnes | ..... | A63B 24/0021<br>473/471 |
| 5,876,291 | A * | 3/1999 | Dubose | ..... | A63B 63/00<br>473/197 |
| 2005/0200079 | A1 * | 9/2005 | Barber | ..... | A63B 63/008<br>473/476 |

* cited by examiner

SPORTS PROJECTILE TRAINING DEVICE

FIELD OF THE INVENTION

This patent specification relates to the field of devices for helping a sports player ascertain the path or impact of a sports projectile. More specifically, this patent specification relates to a device for helping a sports player ascertain the path or impact of a sports projectile to improve their projectile aiming ability.

BACKGROUND

Many sports utilize projectiles which sports players must interact with. Success in these sports are often determined by the players' ability to motivate the projectile in a desired path or to a desired destination. For example, baseball players, such as pitchers, are required to throw a baseball towards another player's glove. As another example, American football quarterbacks are required to throw a football at a specific receiver. As a further example, a golfer must be able to hit a golf ball with a precise and practiced swing. In order to consistently motivate a projectile, these sports players must practice or perform countless projectile motivating repetitions. While it may be convenient to practice by motivating a sports projectile between two individuals, many sports players are limited for various reasons to practicing alone. Although some solo practice devices exist, they are essentially back-stops and are unable to provide the individual with a visual record of their past projectile flight paths or impacts.

Therefore, a need exists for novel devices for helping a sports player ascertain the path or impact of a sports projectile. A further need exists for novel devices for helping a sports player ascertain the path or impact of a sports projectile to improve their projectile aiming ability. There is also a need for novel sports projectile training devices which provide the individual with a visual record of their past projectile flight paths or impacts.

BRIEF SUMMARY OF THE INVENTION

A sports projectile training device is provided. The device may be used to stop the flight of a sports projectile, such as a baseball, softball, tennis ball, field hockey ball, football, soccer ball, lacrosse ball, hockey puck, etc. In some embodiments, the device may include a frame having a frame aperture. A base sheet may be coupled to the frame and the base sheet may extend across portions of the frame aperture. The base sheet may include a plurality of base apertures. Each base aperture may be sized and shaped so that the sports projectile may pass into and through the base aperture. A cover sheet having an exterior surface may be positioned over the base sheet so that the exterior surface and base sheet are positioned on opposing sides of the cover sheet. The exterior surface may be sized and shaped to be larger than the frame aperture. A sports projectile may be motivated towards the device so that the sports projectile impacts the exterior surface. This impact may cause the sports projectile to press a portion of the cover sheet into a base aperture to arrest the sports projectile within the base aperture so that the sports projectile is cradled in the base aperture by the exterior surface. The sports projectile may remain in the base aperture until it is removed by an individual, thereby providing a record of the location of the sports projectile impact which may be used by the motivator of the sports projectile to improve their aim.

In further embodiments, the base sheet may include a netting material which may form a plurality of base apertures.

In still further embodiments, each base aperture may have a base aperture width dimension and a base aperture height dimension, and the sports projectile may have a projectile width dimension and a projectile height dimension. The base aperture width dimension may be 101 percent to 1,000 percent of the projectile width dimension, and the base aperture height dimension may be 101 percent to 1,000 percent of the projectile height dimension.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
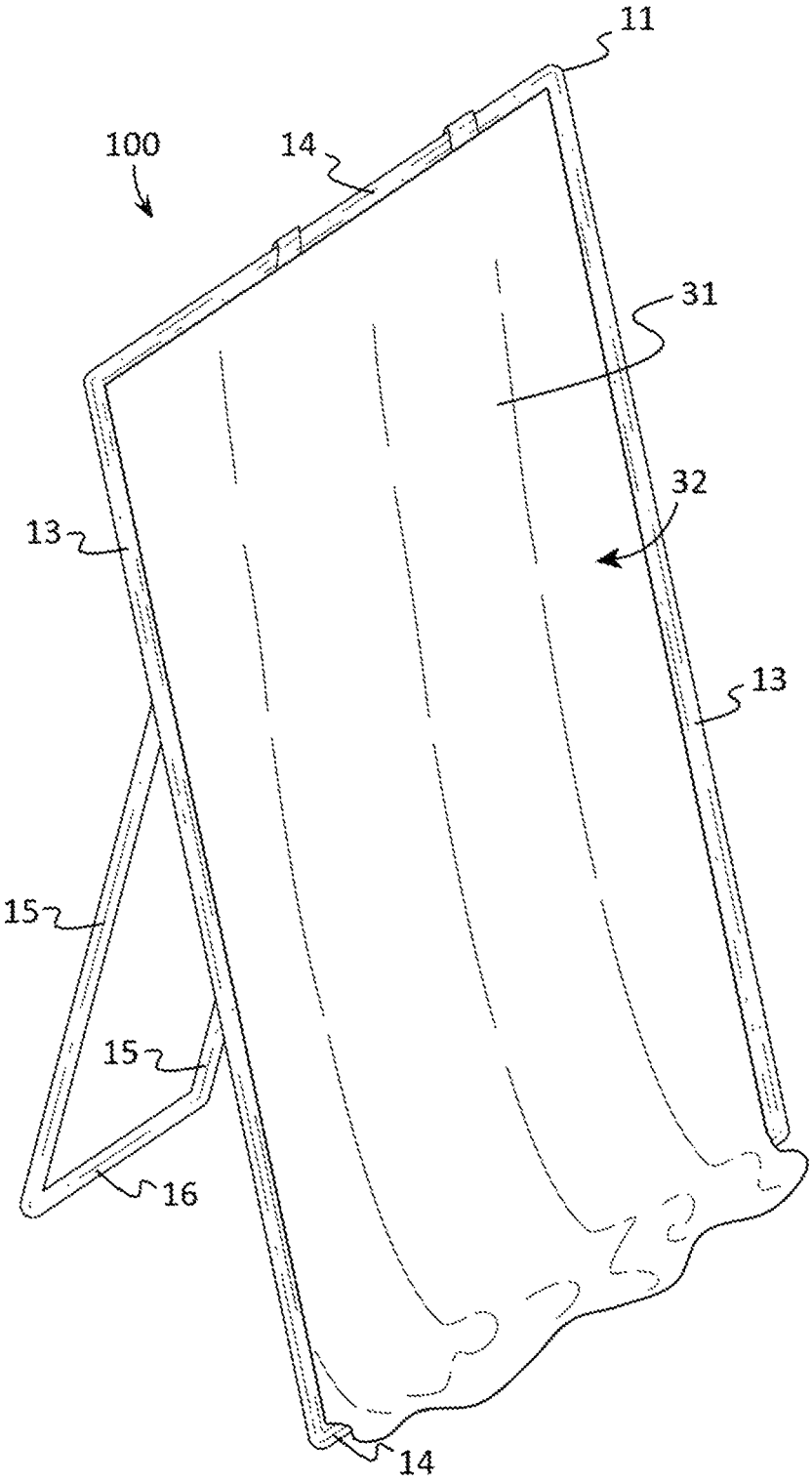
FIG. 1 depicts a perspective view of an example of a sports projectile training device according to various embodiments described herein.
Figure 2:
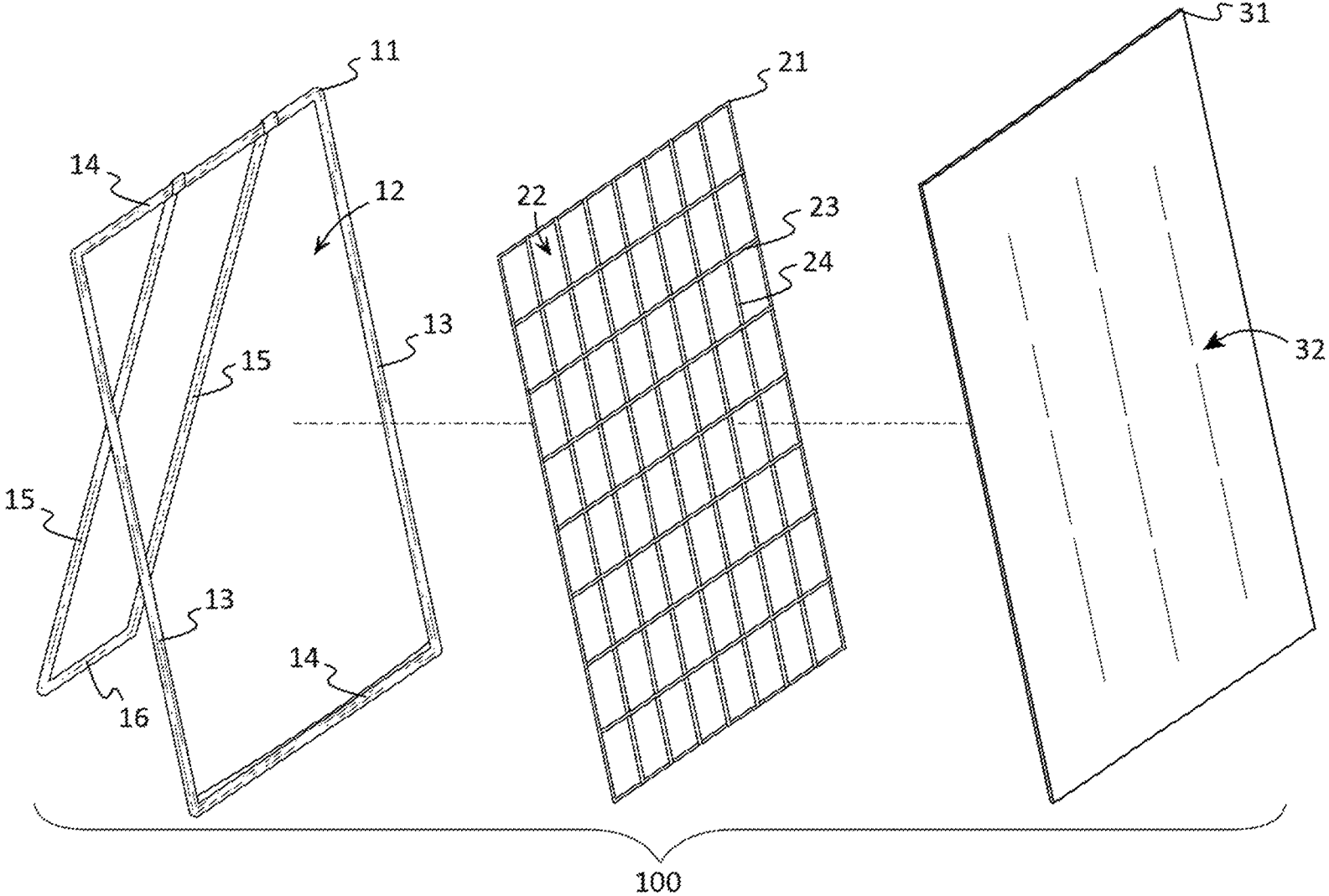
FIG. 2 illustrates a perspective exploded view of an example of a sports projectile training device according to various embodiments described herein.
Figure 3:
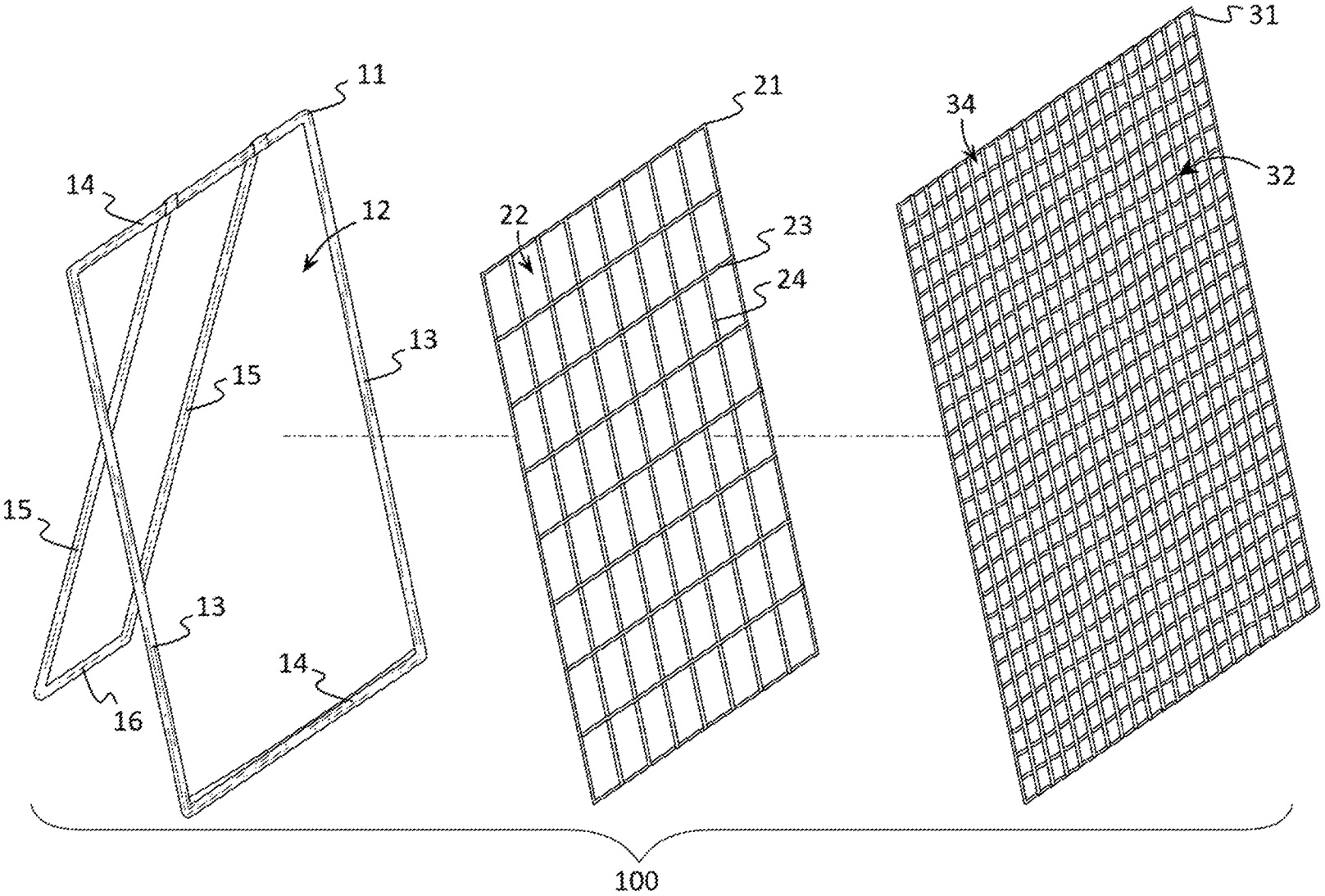
FIG. 3 shows a perspective exploded view of another example of a sports projectile training device according to various embodiments described herein.
Figure 4:
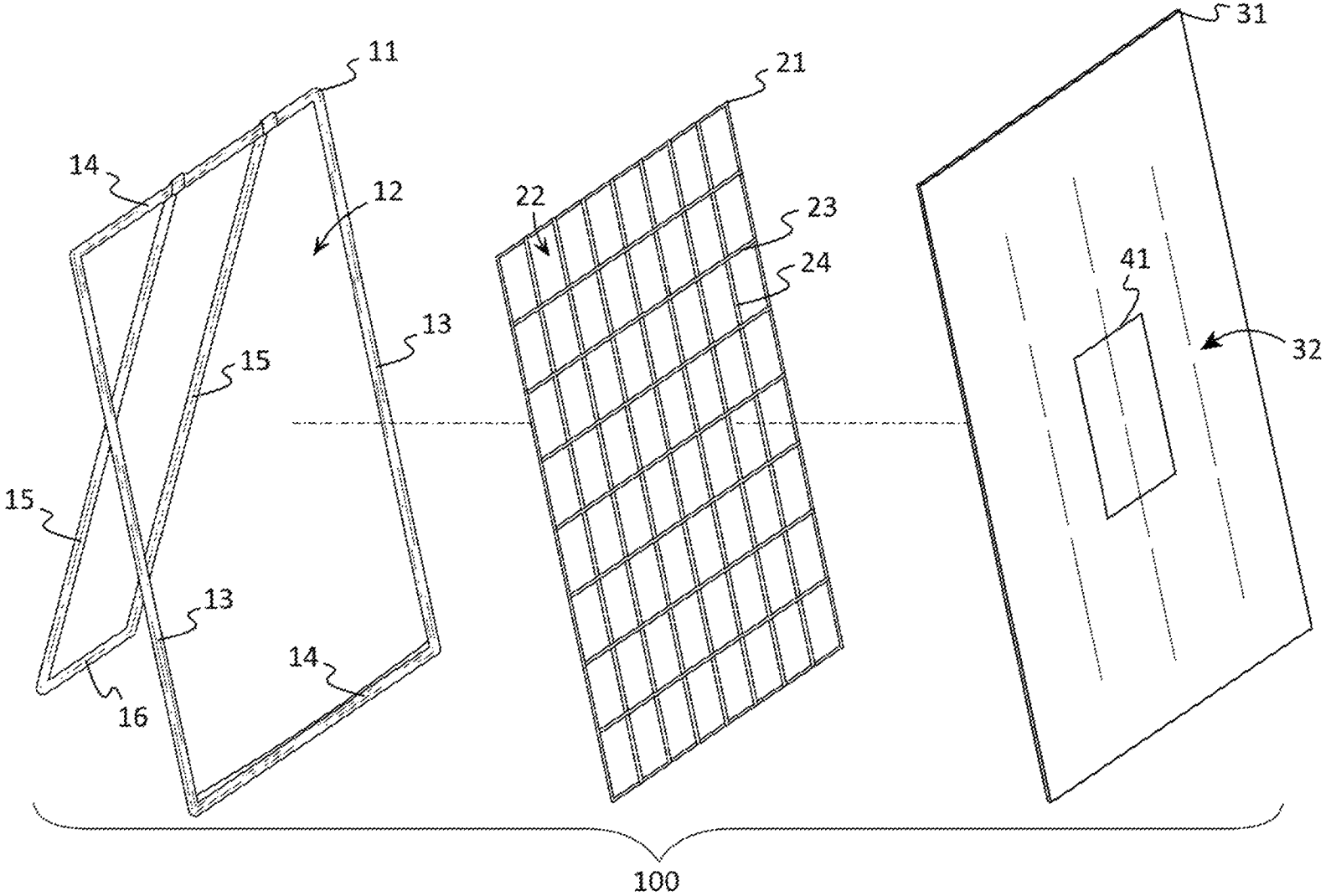
FIG. 4 depicts a perspective exploded view of still another example of a sports projectile training device according to various embodiments described herein.
Figure 5:
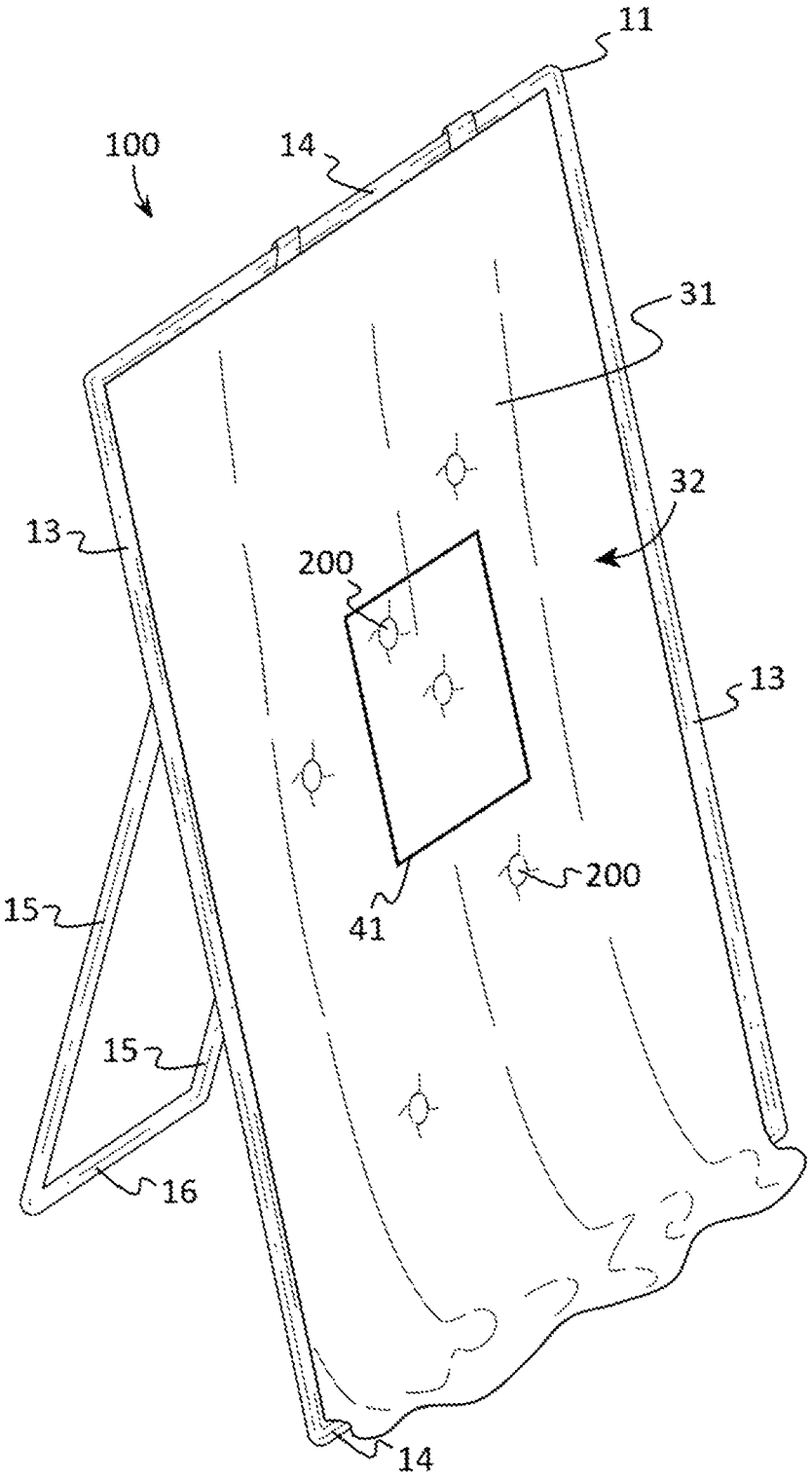
FIG. 5 illustrates a perspective view of an example of a sports projectile training device with approximately six sports projectiles cradled within base apertures by a cover sheet according to various embodiments described herein.
Figure 6:
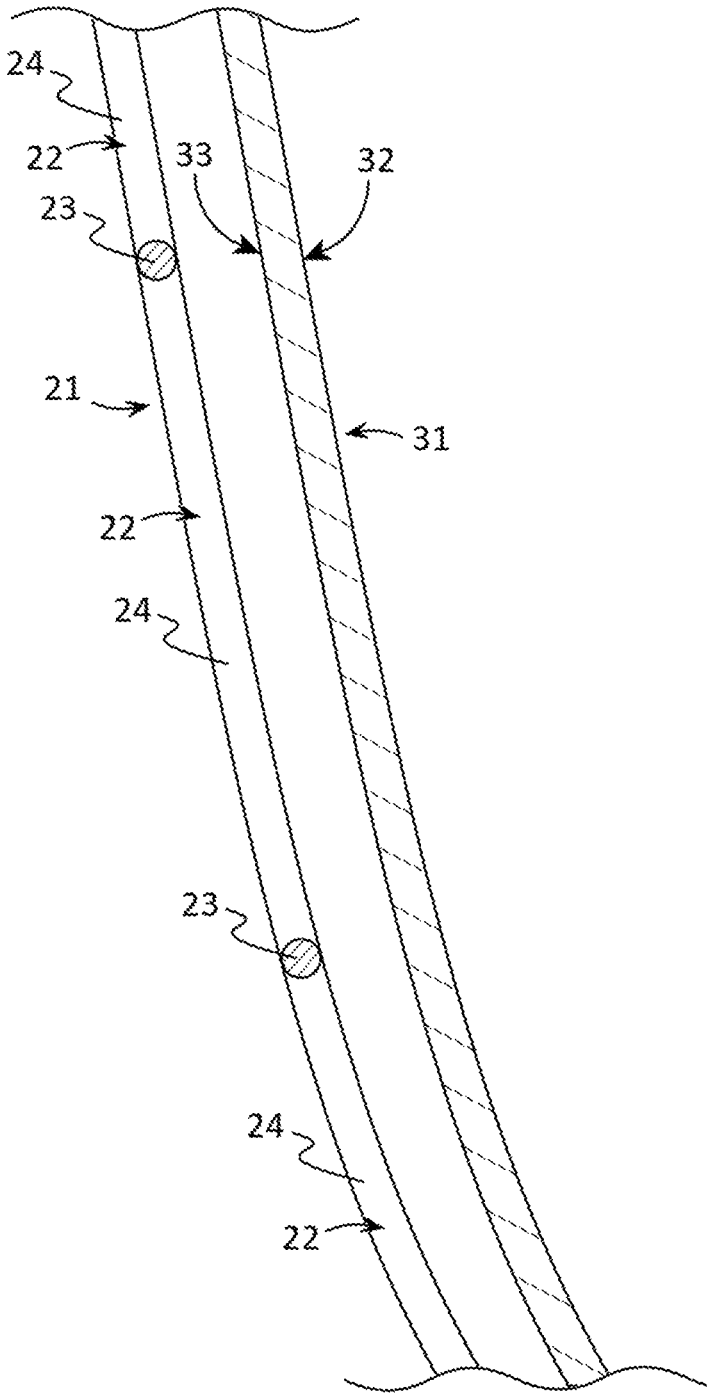
FIG. 6 shows a sectional, elevation view of an example of a cover sheet and base sheet according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new sports projectile training device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-5 illustrate examples of a sports projectile training device ("the device") 100 according to various embodiments. The device 100 may be used to stop the flight of a sports projectile 200, such as a baseball, softball, tennis ball, field hockey ball, football, soccer ball, lacrosse ball, hockey puck, golf ball, etc. In some embodiments, the device 100 may comprise a frame 11 having a frame aperture 12. A base sheet 21 may be coupled to the frame 11 and the base sheet 21 may extend across the frame aperture 12. The base sheet 21 may comprise a plurality of base apertures 22. Each base aperture 22 may be sized and shaped so that the sports projectile 200 may pass into and through the base aperture 22. A cover sheet 31 having an exterior surface 32 may be positioned over the base sheet 21 so that the exterior surface 32 and base sheet 21 are positioned on opposing sides of the cover sheet 31. The exterior surface 32 may be sized and shaped to be larger than the frame aperture 12. A sports projectile 200 may be motivated towards the device 100 so that the sports projectile 200 impacts the exterior surface 32. This impact may cause the sports projectile 200 to press a portion of the exterior surface 32 into a base aperture 22 to arrest the sports projectile 200 within the base aperture 22 so that the sports projectile 200 is cradled in the base aperture 22 by the exterior surface 32. The sports projectile 200 may remain in the base aperture 22 until it is removed by an individual, thereby providing a record of the location of the sports projectile 200 impact which may be used by the motivator of the sports projectile 200 to improve their aim.

The device 100 may comprise a frame 11 which may be configured to support the base sheet 21 and cover sheet 31. In preferred embodiments, a frame 11 may comprise two vertical beams 13 and two horizontal beams 14 which may be coupled together to form a generally rectangular shape. In other embodiments, the frame 11 may comprise one, two, three, five, six, seven, or more beams 13, 14, which may be coupled together in a circular shape, oval shape, triangular shape, or any other shape.

In some embodiments, frame 11 may also comprise one or more support legs 15 which may be coupled to one or more beams 13, 14, and which may be used to position and orient the frame 11 over a supporting surface, such as the ground. Optionally, one or more leg braces 16 may be coupled to the one or more support legs 15 to provide structural reinforcement to the support legs 15. In preferred embodiments, one or more support legs 15 may be movably coupled to a beam 13, 14, such as with a hinge, rivet-type pivotal coupling, or any other movable coupling, to enable the support legs 15 to be folded or moved into a compact position, such as to facilitate storage or travel.

The beams 13, 14, may be made from or comprise steel alloys, aluminum, aluminum alloys, copper alloys, other types of metal or metal alloys, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly (methyl methacrylate) (PMMA) also known as acrylic, melamine, hard rubbers, fiberglass, carbon fiber, resins, such as epoxy resin, wood, other plant based materials, or any other material including combinations of materials that are substantially rigid and suitable for securing and positioning the sheets 21, 31, against impacts from sports projectiles 200.

The device 100 may comprise one or more frame apertures 12. Generally, the frame 11 may be configured to support the base sheet 21 and cover sheet 31 so that portions of the sheets 21, 31, may be positioned over the frame aperture(s) 12. A frame aperture 12 may be configured in any shape and size. In preferred embodiments, the frame 11 may comprise a single frame aperture 12 that may be defined by the shape, size, and arrangement of the beams 13, 14, such as a rectangular shape formed by two vertical beams 13 and two horizontal beams 14. In other embodiments, the frame 11 may comprise two, three, four, five, six, seven, or more, such as a plurality of, frame apertures 12. Frame aperture(s) 12 may be configured in any shape and size that may enable a sports projectile 200 to pass through the frame aperture(s) 12.

In some embodiments, one or more beams 13, 14, and/or support legs 15 may comprise a fixed length. In further embodiments, one or more beams 13, 14, and/or support legs 15 may be extendable/retractable and/or comprise one or more sections which may be added/removed to enable the one or more beams 13, 14, and/or support legs 15 to be adjustable in length. For example, the beams 13, 14, may be adjustable in length so that by increasing and decreasing the length of the beams 13, 14, may likewise increase and decrease the size of the frame aperture 12, respectively.

The device 100 may comprise a base sheet 21 which may be coupled to the frame 11 so that the base sheet 21 extends across portions of the one or more frame apertures 12. In preferred embodiments, the base sheet 21 may be coupled to the frame 11 so that the base sheet 21 extends across an entire frame aperture 12. A base sheet 21 may be configured in any size and shape. In preferred embodiments, the base sheet 21 may be larger than a frame aperture 12 so that the base sheet 21 may cover the frame aperture 12 without being drawn taught or in a rigid manner across the frame aperture 12.

A base sheet 21 may comprise one or more base apertures 22. In preferred embodiments, a base sheet 21 may comprise a plurality of base apertures 22, such as nine or more base apertures 22. Base apertures 22 may be configured in any size and shape, such as rectangular, circular, hexagonal, triangular, etc. Generally, each base aperture 22 may be sized and shaped to allow a desired sports projectile 200 to pass into and through the base aperture 22. In some embodiments, the base apertures 22 of the base sheet 21 may be approximately equal in size and/or shape. In other embodiments, one or more base apertures 22 may comprise a different size and/or shape than another base aperture 22.

Figure 8:
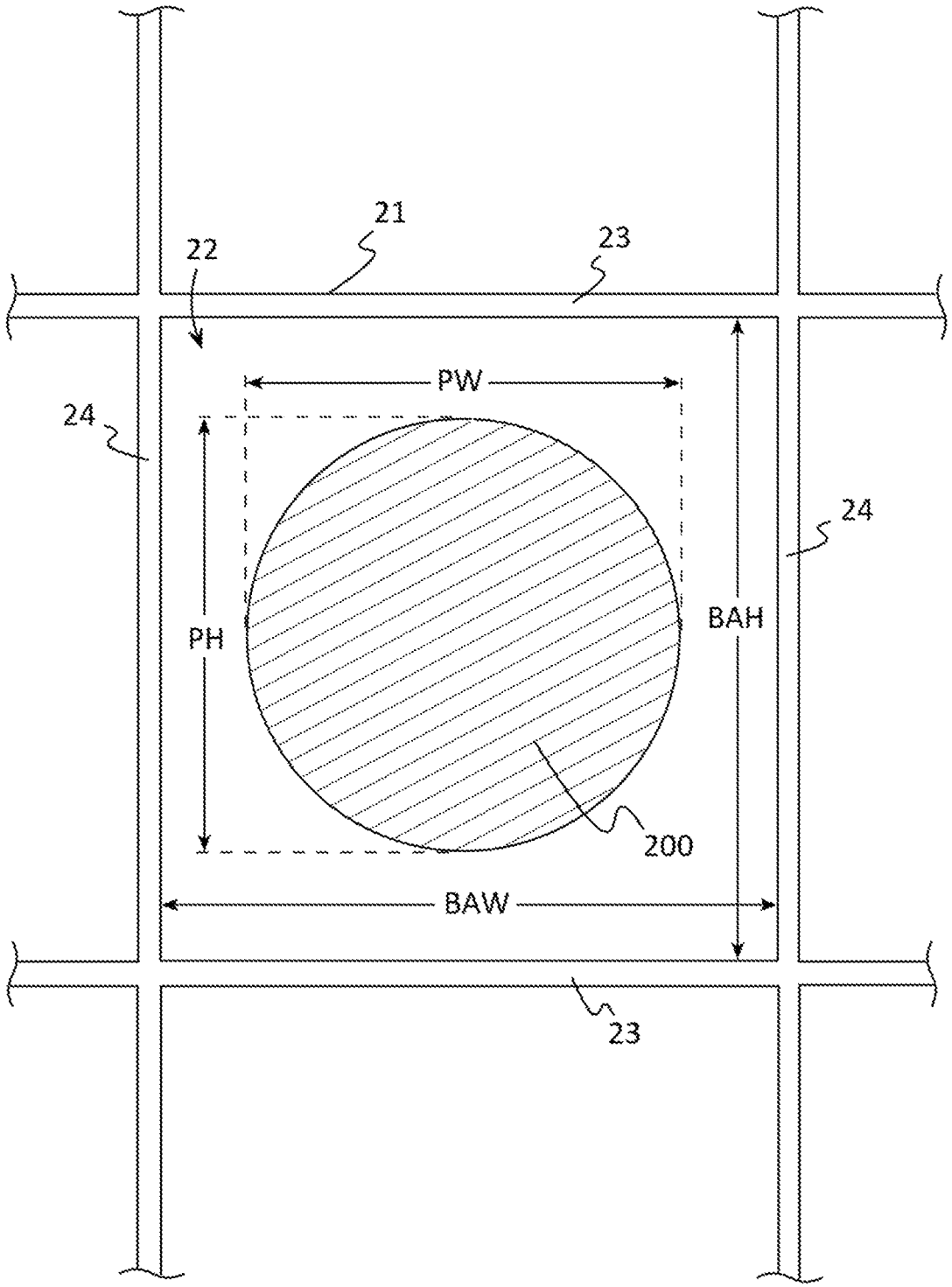
FIG. 8 illustrates a sectional view an example sports projectile positioned relative to an example base aperture of a base sheet according to various embodiments described herein.

Optionally, a base aperture 22 may be bounded and formed by one or more base horizontal supports 23 and/or base vertical supports 24. As shown in FIG. 8, each base aperture 22 may comprise a base aperture width dimension (BAW) and a base aperture height dimension (BAH). A base aperture width dimension (BAW) may describe the widest dimension of the base aperture 22 that is generally perpendicular to the base aperture height dimension (BAH). Likewise, a base aperture height dimension (BAH) may describe the widest dimension of the base aperture 22 that is generally perpendicular to the aperture width dimension (BAW). In this example, the base aperture 22 comprises a relatively rectangular shape (formed by two parallel and opposing base horizontal supports 23 and two parallel and opposing base vertical supports 24) so the BAW may be substantially uniform across the entire width of the base aperture 22, and the BAH may also be substantially uniform across the entire height of the base aperture 22. As another example, a base aperture 22 may comprise a generally circular shape, hexagonal shape, etc., so that the BAW and BAH may be measured generally centrally in the base aperture 22.

Generally, the BAH and BAW of a base aperture 22 may be dimensioned to allow one or more sports projectiles 200 to pass into and through the base aperture 22. As shown in FIG. 8, a sports projectile 200 may comprise a projectile width dimension (PW) and a projectile height dimension (PH). A projectile width dimension (PW) may describe the widest cross-sectional dimension of a sports projectile 200 desired to be used with the device 100 that is generally perpendicular to the projectile height dimension (PH). Likewise, a projectile height dimension (PH) may describe the widest cross-sectional dimension of a sports projectile 200 desired to be used with the device 100 that is generally perpendicular to the projectile width dimension (PW). In this example, the sports projectile 200 comprises a relatively circular cross-sectional shape so the PW may be substantially equal to the PH, such as which baseball, softball, golf ball, American football, soccer, tennis, etc., type sports projectiles. As another example, a sports projectile may not comprise a substantially circular cross-sectional shape so that the PW and PH may not be substantially equal.

The device 100 may comprise one or more base apertures 22 which may be sized and shaped to have a BAH and/or BAW that is greater than the PH and/or PH of a desired sports projectile 200 to allow the desired sports projectile 200 to pass into and through each base aperture 22. In some embodiments, the device 100 may comprise one or more base apertures 22 having a BAH that is 101 percent to 1,000 percent the PH and/or PW of a desired sports projectile 200. In preferred embodiments, the device 100 may comprise one or more base apertures 22 having a BAH that is 150 percent to 500 percent the PH and/or PW of a desired sports projectile 200. In some embodiments, the device 100 may comprise one or more base apertures 22 having a BAW that is 101 percent to 1,000 percent the PH and/or PW of a desired sports projectile 200. In preferred embodiments, the device 100 may comprise one or more base apertures 22 having a BAW that is 150 percent to 500 percent the PH and/or PW of a desired sports projectile 200.

In some embodiments, one or more base apertures 22 of a base sheet 21, including each base aperture 22 of the base sheet 21, may comprises BAW of between approximately 1.0 and 36.0 inches, and more preferably between approximately 2.0 and 12.0 inches. In further embodiments, one or more base apertures 22 of a base sheet 21, including each base aperture 22 of the base sheet 21, may comprises BAH of between approximately 1.0 and 36.0 inches, and more preferably between approximately 2.0 and 12.0 inches.

A base sheet 21 may be made from any suitable material which is capable of forming one or more base apertures 22. In some embodiments, a base sheet 21 may be substantially rigid and may be made from or may comprise steel alloys, aluminum, aluminum alloys, copper alloys, other types of metal or metal alloys, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials that are substantially rigid. For example, a base sheet 21 may be made of a generally rigid cage/fence design with a plurality of slats, bars, or the like, which may be spaced apart to form base apertures 22.

In preferred embodiments, a base sheet 21 may be substantially flexible and/or resilient and may be made from or may comprise a flexible material such as natural and/or synthetic rubber material such as latex rubber, silicone foam, silicone rubber, rubber foam, urethane foam, plastic foam, neoprene foam, latex foam rubber, polyurethane foam rubber, forms of the organic compound isoprene, Polyacrylate Rubber, Ethylene-acrylate Rubber, Polyester Urethane, flexible plastics, such as high-density polyethylene (HDPE), polyvinyl chloride (PVC), polypropylene (PP), Polystyrene (PS), Polycarbonate (PC), low density polyethylene (LDPE), various types of flexible plastics such as polyvinyl chloride, natural or synthetic rubber, synthetic fabrics such as polyester, acrylic, nylon, rayon, acetate, spandex, spandex blends, and Kevlar, and natural fabrics such as coir, cotton, hemp, jute, canvas, flax, leather, linen, ramie, wool, silk, or any other suitable flexible natural or synthetic material including combinations of materials.

In further preferred embodiments, a base sheet 21 may be made from or may comprise a netting material that may be made from a material having a plurality of structural elements that are fused, looped, or knotted at their intersections, resulting in a netting material with open spaces between the structural elements, and these open spaces may form the base apertures 22. A netting material may include various types and styles of plastic and/or metal wire or mesh netting such as nylon netting, tarred nylon netting, polyester barrier mesh, polyester debris fabric, natural and/or synthetic rope netting, Textilene mesh, vinyl coated mesh, chain link fencing, wire fencing, chain netting, chain mesh, metal screen, plastic screen, fabric screen, or any other netting or fencing material including netting commonly used for fishing industries and/or sporting equipment or purposes.

Figure 7:
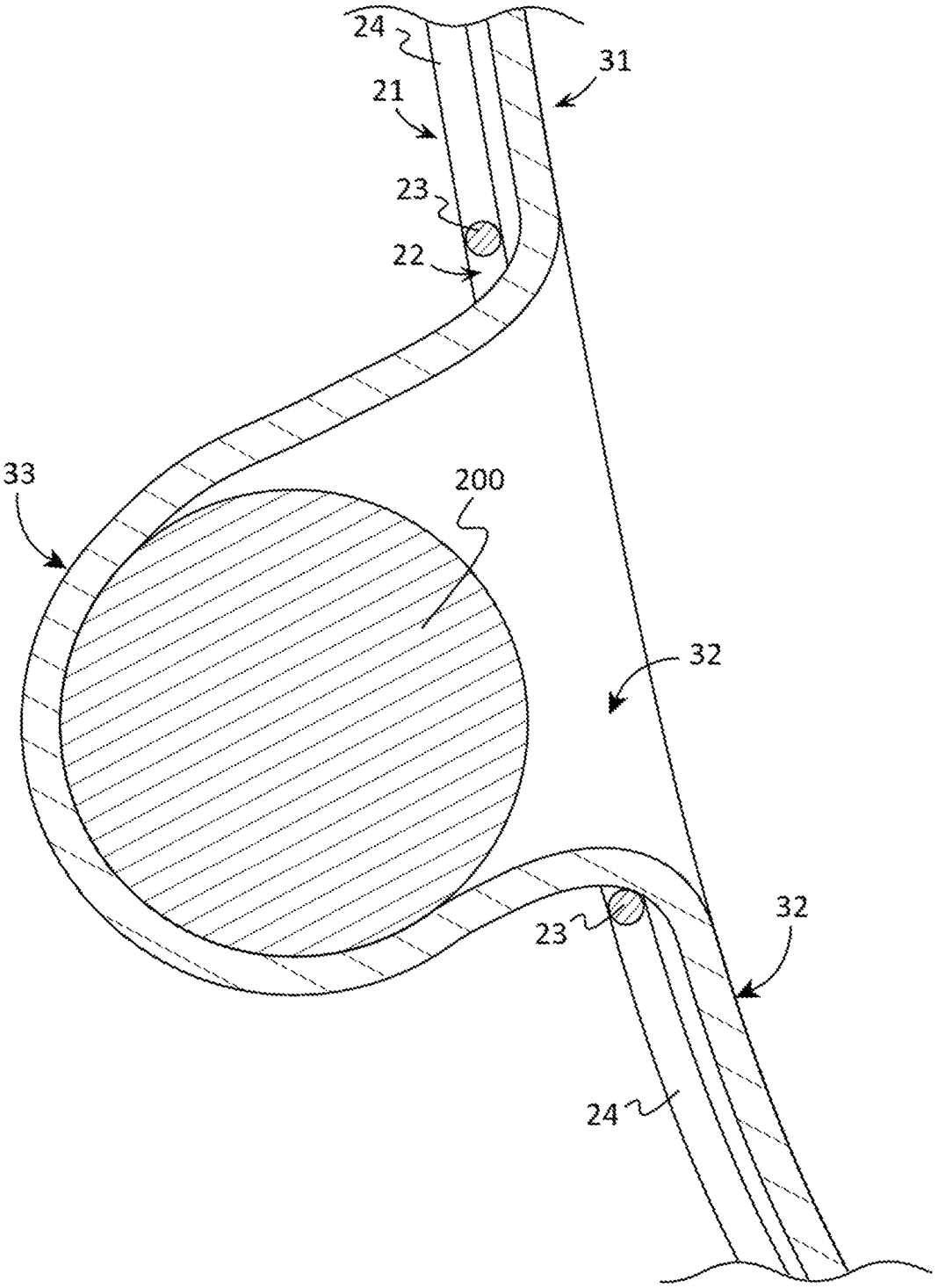
FIG. 7 depicts a sectional, elevation view of an example of a cover sheet and base sheet showing a sports projectile cradled within a base aperture by a cover sheet according to various embodiments described herein according to various embodiments described herein.

The device 100 may comprise a cover sheet 31 which may be the first point of contact between the device 100 and a sports projectile 200 that is motivated towards the frame aperture 12. The exterior surface 32 may be sized and shaped to be larger than the frame aperture 12. A cover sheet 31 may be configured to stop or arrest the movement of the sports projectile 200 so that the sports projectile 200 is unable to pass through the frame aperture 12 and a base aperture 22 to continue on its original trajectory. Generally, a cover sheet 31 may be loosely coupled to the frame 11 and/or base sheet 21 so that the cover sheet 31 has enough slack so that an impact of a sports projectile 200 with the device 100 within the frame aperture 12 causes the sports projectile 200 to press a portion of the cover sheet 31 into a base aperture 22 to arrest the sports projectile 200 within the base aperture 22 so that the sports projectile 22 is cradled by the portion of the cover sheet 31 that is in the base aperture 22 as perhaps best shown in FIG. 7.

In some embodiments, a cover sheet 31 may comprise an exterior surface 32 and an opposing interior surface 33. The cover sheet 31 may be coupled to the fame 11 and/or base sheet 21, and the cover sheet 31 may be positioned over the base sheet 21 so that the exterior surface 32 and base sheet 21 are positioned on opposing sides of the cover sheet 31. In this manner, the interior surface 33 may be positioned proximate to the base sheet 21 and may contact the base sheet 21 while a sports projectile 22 is cradled by the cover sheet 31 in a base aperture 22.

In some embodiments, a cover sheet 31 may comprise a sheet of flexible material which may allow portions of the cover sheet 31 to be pressed into and removed from being positioned within a base aperture 22. In preferred embodiments, a cover sheet 31 may be made from or may comprise a sheet of flexible material such as natural and/or synthetic rubber material such as latex rubber, silicone foam, silicone rubber, rubber foam, urethane foam, plastic foam, neoprene foam, latex foam rubber, polyurethane foam rubber, forms of the organic compound isoprene, Polyacrylate Rubber, Ethylene-acrylate Rubber, Polyester Urethane, flexible plastics, such as high-density polyethylene (HDPE), polyvinyl chloride (PVC), polypropylene (PP), Polystyrene (PS), Polycarbonate (PC), low density polyethylene (LDPE), various types of flexible plastics such as polyvinyl chloride, natural or synthetic rubber, synthetic fabrics such as polyester, acrylic, nylon, rayon, acetate, spandex, spandex blends, and Kevlar, and natural fabrics such as coir, cotton, hemp, jute, canvas, flax, leather, linen, ramie, wool, silk, or any other suitable flexible natural or synthetic material including combinations of materials.

Optionally, a cover sheet 31 may comprise one or more cover apertures 34. Cover apertures 34 may be made in any size and shape which is smaller than a desired sports projectile 200 so that the sports projectile 200 may not be able to pass into or through the cover apertures 34. In further preferred embodiments, a cover sheet 31 may be made from or may comprise a netting material that may be made from a material having a plurality of structural elements that are fused, looped, or knotted at their intersections, resulting in a netting material with open spaces between the structural elements, and these open spaces may form the cover apertures 34. A netting material may include various types and styles of plastic and/or metal wire or mesh netting such as nylon netting, tarred nylon netting, polyester barrier mesh, polyester debris fabric, natural and/or synthetic rope netting, Textilene mesh, vinyl coated mesh, chain link fencing, wire fencing, chain netting, chain mesh, metal screen, plastic screen, fabric screen, or any other netting or fencing material including netting commonly used for fishing industries and/or sporting equipment or purposes.

Figure 9:
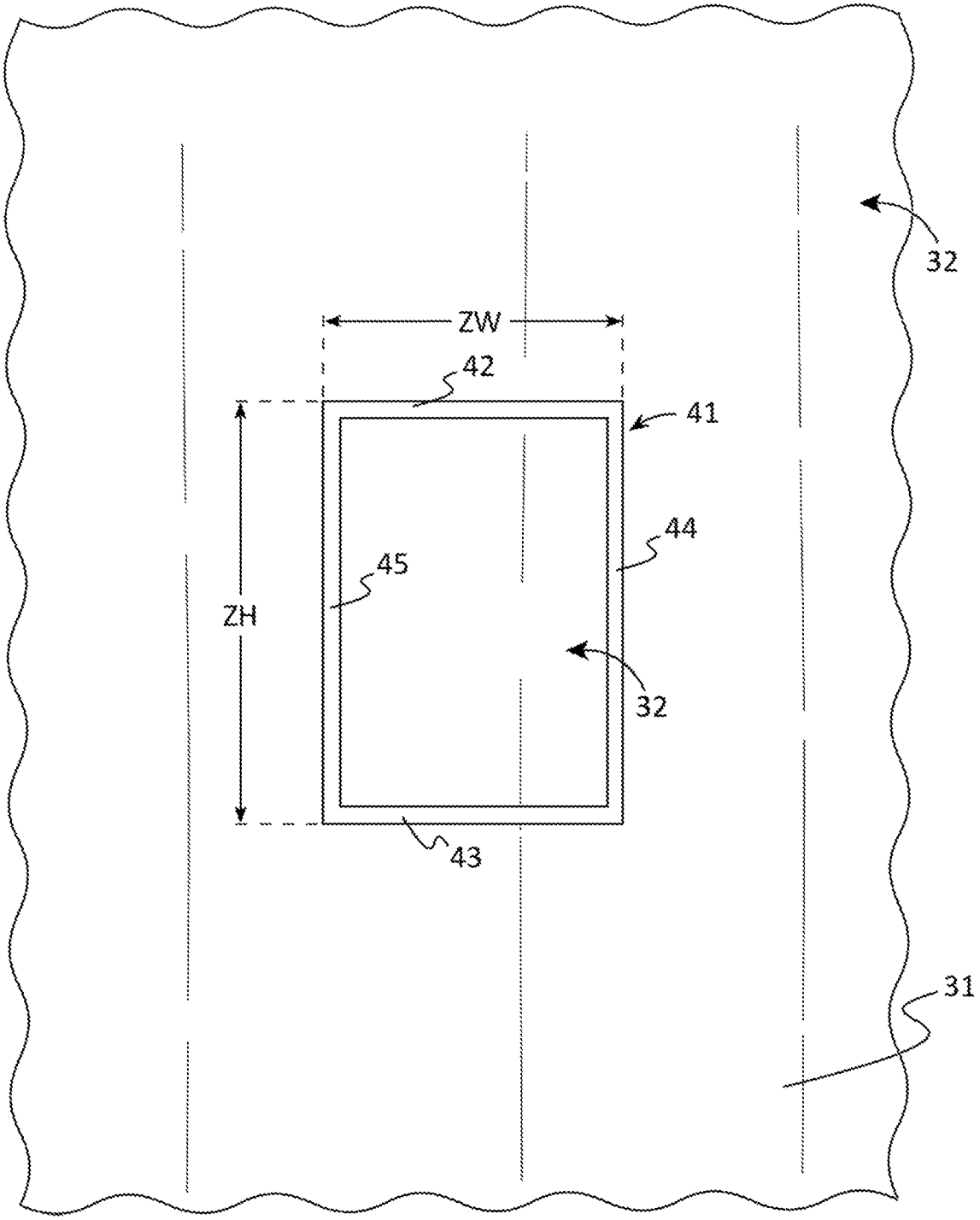
FIG. 9 shows a perspective view of an example of a zone delineator coupled to a portion of a cover sheet according to various embodiments described herein.

In some embodiments, the device 100 may comprise a zone delineator 41 which may provide a visual indicator that may serve as a target for a desired sports projectile 200. A zone delineator 41 may comprise an upper face 42, a lower face 43, a right face 44, and/or a left face 45 which may be sized and shaped so that the zone delineator 41 may be configured in any size and shape. As shown in FIG. 9, a zone delineator 41 may comprise a zone width dimension (ZW) and a zone height dimension (ZH). A zone width dimension (ZW) may describe the widest dimension of the zone delineator 41 that is generally perpendicular to the zone height dimension (ZH). Likewise, a zone height dimension (ZH) may describe the widest dimension of the zone delineator 41 that is generally perpendicular to the zone width dimension (ZW). In this example, the zone delineator 41 comprises a relatively rectangular shape so the ZW may be substantially uniform across the entire width of the zone delineator 41, and the ZH may also be substantially uniform across the entire height of the zone delineator 41. As another example, a zone delineator 41 may comprise a generally circular shape, oval shape, hexagonal shape, etc., so that the ZW and ZH may be measured generally centrally in the zone delineator 41.

In some embodiments, the zone height dimension (ZH) is between 5.0 and 120.0 inches, and wherein the zone width dimension (ZW) is between 5.0 inches and 120.0 inches. In preferred embodiments, the zone height dimension (ZH) is between 20.0 and 30.0 inches, and wherein the zone width dimension (ZW) is between 15.0 inches and 22.0 inches.

Generally, a zone delineator 41 may comprise a material that is different that the cover sheet 31 and/or is colored differently than the cover sheet 31 so that the zone delineator 41 may be observable by a user. A zone delineator 41 may be coupled to the exterior surface 32 of the cover sheet 31 which any suitable coupling method. For example, a zone delineator 41 may be screen printed on the exterior surface 32, sewn or stitched on the exterior surface 32, woven into the cover sheet 31, applied with adhesive, etc. In preferred embodiments, a zone delineator 41 may be removably coupled to the exterior surface 32. For example, the zone delineator 41 may comprise one or more strips of material that may be coupled to the exterior surface 32 via hookand-loop or Velcro® fasteners. In further preferred embodiments, a zone delineator 41 may be removably coupled to the exterior surface 32 so that the zone delineator 41 may be resizable and or repositionable.

In some embodiments, the device 100 may be used for helping a sports player user ascertain the path or impact of a sports projectile 200 to improve their projectile aiming ability. Preferably, the device 100 may be positioned so that the exterior surface 32 is facing the user. The user may then throw a sports projectile 200, such as a baseball, at the exterior surface 32. The sports projectile 200 may impact the exterior surface 32 within the frame aperture 12 to cause the sports projectile 200 to press a portion of the cover sheet 31 into a base aperture 22 of the base sheet 21 to arrest the sports projectile 200 within the base aperture 22 so that the sports projectile 200 is cradled by the portion of the cover sheet 31 that is in the base aperture 22. In this manner, the user may observe where the sports projectile impacted versus where they were aiming, subsequently motivated sports projectiles 200 may accumulate in the cover sheet 31 to provide a visual record or the impacts. The user may then simply pull the cover sheet 31 away from the frame 11 and base sheet 21 to release the sports projectiles 200. Preferably, a zone delineator 41 may be coupled to the cover sheet 31 and positioned preferably centrally in the frame aperture 12 to provide an aiming point or area for the user to aim at. For example, a zone delineator 41 may be sized and shaped as a rectangular strike zone of an average baseball player.

While some exemplary shapes and sizes have been provided for elements of the device 100, it should be understood to one of ordinary skill in the art that the frame 11, base sheet 21, cover sheet 31, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A sports projectile training device for use with a sports projectile, the device comprising:

a frame having a frame aperture;

a base sheet coupled to the frame, wherein the base sheet extends across portions of the frame aperture;

a plurality of base apertures formed in the base sheet, wherein each base aperture of the plurality of base apertures is sized and shaped to allow the sports projectile to pass into and through each base aperture; and a cover sheet having an exterior surface, the cover sheet positioned over the base sheet so that the exterior surface and base sheet are positioned on opposing sides of the cover sheet, wherein the exterior surface is sized and shaped to be larger than the frame aperture, wherein the impact of the sports projectile within the frame aperture causes the sports projectile to press a portion of the cover sheet into a base aperture of the plurality of base apertures to arrest the sports projectile within the base aperture so that the sports projectile is cradled by the portion of the cover sheet that is in the base aperture.

2. The device of claim 1, wherein the frame comprises a support leg.

3. The device of claim 1, wherein the base sheet comprises a netting material.

4. The device of claim 1, wherein the cover sheet comprises a netting material.

5. The device of claim 1, wherein the cover sheet comprises a sheet of flexible material.

6. The device of claim 1, wherein the cover sheet is coupled to one of the frame and the base sheet.

7. The device of claim 1, wherein each base aperture comprises a base aperture width dimension and a base aperture height dimension, wherein the sports projectile comprises a projectile width dimension and a projectile height dimension, wherein the base aperture width dimension of each base aperture is greater than the projectile width dimension and the projectile height dimension, and wherein the base aperture height dimension is greater than the projectile width dimension and the projectile height dimension.

8. The device of claim 1, wherein each base aperture comprises a base aperture width dimension and a base aperture height dimension, wherein the sports projectile comprises a projectile width dimension and a projectile height dimension, wherein the base aperture width dimension is 101 percent to 1,000 percent of the projectile width dimension, and wherein the base aperture height dimension is 101 percent to 1,000 percent of the projectile height dimension.

9. The device of claim 1, a base aperture of the plurality of base apertures comprises a base aperture width dimension of between 2.0 and 12.0 inches, and wherein the base aperture of the plurality of base apertures comprises a base aperture height dimension of between 2.0 and 12.0 inches.

10. The device of claim 1, further comprising a zone delineator.

11. The device of 9, wherein the zone delineator comprises a zone height dimension and a zone width dimension, wherein the zone height dimension is between 20.0 and 30.0 inches, and wherein the zone width dimension is between 15.0 inches and 22.0 inches.

12. The device of 9, wherein the zone delineator is removably coupled to the cover sheet.

13. A sports projectile training device for use with a sports projectile, the device comprising:

a frame having a frame aperture;

a base sheet coupled to the frame, wherein the base sheet extends across portions of the frame aperture, and wherein the base sheet comprises a netting material;

a plurality of base apertures formed in the base sheet, wherein each base aperture of the plurality of base apertures is sized and shaped to allow the sports projectile to pass into and through each base aperture, wherein each base aperture comprises a base aperture width dimension and a base aperture height dimension, and wherein the sports projectile comprises a projectile width dimension and a projectile height dimension, wherein the base aperture width dimension is 101 percent to 1,000 percent of the projectile width dimension, and wherein the base aperture height dimension is 101 percent to 1,000 percent of the projectile height dimension; and a cover sheet having an exterior surface, the cover sheet positioned over the base sheet so that the exterior surface and base sheet are positioned on opposing sides of the cover sheet, wherein the exterior surface is sized and shaped to be larger than the frame aperture, wherein the impact of the sports projectile within the frame aperture causes the sports projectile to press a portion of the cover sheet into a base aperture of the plurality of base apertures to arrest the sports projectile within the base aperture so that the sports projectile is cradled by the portion of the cover sheet that is in the base aperture.

14. The device of claim 13, wherein the cover sheet comprises a netting material.

15. The device of claim 13, wherein the cover sheet comprises a sheet of flexible material.

16. The device of claim 13, wherein the cover sheet is coupled to one of the frame and the base sheet.

17. The device of claim 13, wherein a base aperture of the plurality of base apertures comprises a base aperture width dimension of between 2.0 and 12.0 inches, and wherein the base aperture of the plurality of base apertures comprises a base aperture height dimension of between 2.0 and 12.0 inches.

18. The device of claim 13, further comprising a zone delineator.

19. The device of 18, wherein the zone delineator comprises a zone height dimension and a zone width dimension, wherein the zone height dimension is between 20.0 and 30.0 inches, and wherein the zone width dimension is between 15.0 inches and 22.0 inches.

20. The device of 18, wherein the zone delineator is removably coupled to the cover sheet.

* * * * *